United States Patent [19]

Theurer et al.

[11] Patent Number: 4,892,151

[45] Date of Patent: Jan. 9, 1990

[54] BALLAST CLEANING MACHINE

[75] Inventors: Josef Theurer, Vienna; Manfred Brunninger, Linz, both of Austria

[73] Assignee: Franz Plasser Bahnbaumaschinen-Industrie GmbH, Vienna, Austria

[21] Appl. No.: 655,766

[22] Filed: Oct. 1, 1984

[30] Foreign Application Priority Data

Dec. 22, 1983 [AT] Austria ..... 4495/83

[51] Int. Cl.[4] ..... E01B 27/00

[52] U.S. Cl. ..... 171/16; 209/311

[58] Field of Search ..... 171/16; 104/2, 7 A, 104/7 B; 209/311, 313, 247

[56] References Cited

U.S. PATENT DOCUMENTS

| | | | |
|---|---|---|---|
| 457,923 | 8/1891 | Morse | 209/311 |
| 865,261 | 9/1907 | Mehaffey | 171/16 |
| 1,282,127 | 10/1918 | Richardson | 209/313 |
| 2,297,486 | 9/1942 | Linke et al. | 209/311 |
| 3,900,392 | 8/1975 | Speno et al. | 171/16 X |
| 3,957,000 | 5/1976 | Plasser et al. | 171/16 |
| 4,004,524 | 1/1977 | Scheuchzer et al. | 171/16 |
| 4,355,687 | 10/1982 | Theurer et al. | 171/16 |
| 4,450,771 | 5/1984 | Theurer et al. | 104/2 |
| 4,530,403 | 7/1985 | Theurer et al. | 171/16 |
| 4,534,415 | 8/1985 | Theurer et al. | 171/16 |

FOREIGN PATENT DOCUMENTS

| | | | |
|---|---|---|---|
| 2456027 | 6/1975 | Fed. Rep. of Germany | 171/16 |
| 329659 | 6/1958 | Switzerland | 171/16 |

*Primary Examiner*—Richard J. Johnson

*Attorney, Agent, or Firm*—Kurt Kelman

[57] ABSTRACT

A ballast cleaning machine comprises a chain for excavating the ballast and for conveying the excavated ballast to a discharge end, a screening installation arranged to receive the excavated ballast from the discharge end of the excavating and conveying chain, and to clean the received ballast by separating waste therefrom. The screening installation comprises a supporting frame and two sets of vibratory screens extending obliquely with respect to the track in the direction of elongation of the machine, the sets of screens being arranged sequentally in said direction and having a common inlet area receiving the ballast from the chain at a respective upper end of each set of screens, the two sets of screens having facing sides adjacent each other and the obliquely extending screens descending from the respective upper end whereby the screens of the two sets enclose an angle. A conveyor band arrangement extends in this direction at least partially below the screening installation, the conveyor band arrangement comprising at least one conveyor band for receiving cleaned ballast from the screening installation and at least one further conveyor band for receiving the waste from the screen installation.

10 Claims, 1 Drawing Sheet

BALLAST CLEANING MACHINE

The present invention relates to a track working machine adapted to receive, clean and convey bulk material, particularly a ballast cleaning machine, which comprises a chain mounted for excavating the bulk material and for conveying the excavated bulk material to a discharge end, a screening installation arranged to receive the excavated bulk material from the discharge end of the excavating and conveying chain, and to clean the received bulk material by separating waste from the bulk material, the screening installation comprising a supporting frame, and a conveyor band arrangement extending at least partially below the screening installation, the conveyor band arrangement comprising at least one conveyor band for receiving cleaned bulk material from the screening installation and at least one further conveyor band for receiving the waste from the screen installation.

U.S. Pat. No. 4,355,687, dated Oct. 26, 1982, discloses a track working machine of this general type, wherein the screening installation comprises a set of vibratory screens extending obliquely with respect to the track in the direction of elongation of the machine and has an inlet area receiving the ballast from the chain at an upper end, the obliquely extending screens descending to a lower discharge end for the cleaned ballast. The conveyor band arrangement comprises two conveyor bands for receiving the cleaned ballast from the screening installation and pivotal in a plane parallel to the track for distributing the cleaned ballast, and a conveyor band for receiving the waste from the screening installation arranged centrally between the two conveyor bands under the screening installation for removing the waste in the operating direction of the machine. In addition, two chute arrangements are disposed at the lower discharge end of the screening installation for discharging cleaned ballast at the track shoulders.

German patent application Ser. No. 2,456,027, published June 5, 1975, also relates to a mobile ballast cleaning machine. In this machine, a leading vehicle carries the ballast excavating and conveying arrangement and a trailing vehicle carries the screening installation which receives the excavated ballast from the leading vehicle. The screening installation comprises four pairs of screens, the screens of each pair extending obliquely towards each other transversely to the track to form a funnel-like structure. The pairs of screens are arranged sequentially in the direction of elongation of the machine and have respective inlets at respective upper ends of the screens along the longitudinal sides of the machine for receiving the excavated ballast from a conveyor band arrangement disposed above the screening installation and being equipped with deflecting devices for laterally discharging the excavated ballast to the inlets of the screens. Because of its complex structure, this ballast cleaning machine is very expensive and prone to breakdowns.

U.S. Pat. No. 4,004,524, dated Jan. 25, 1977, deals with a track renewal train incorporating an intermittently operating ballast excavating chain discharging the excavated ballast to a screening installation on a leading track working vehicle for cleaning the ballast. A respective telescopingly extendable conveyor band arrangement is arranged to deliver the excavated ballast to an upper inlet of the obliquely arranged screening installation and to redistribute the cleaned ballast from a lower discharge end of the installation.

It is the primary object of this invention to increase the efficiency of a track working machine adapted to receive, clean and convey bulk material.

In a track working machine of the first-indicated type, the invention accomplishes this and other objects with a screening installation comprising two sets of vibratory screens extending obliquely with respect to the track in the direction of elongation of the machine, the sets of screens being arranged sequentially in said direction and having a common inlet area receiving the bulk material from the chain at a respective upper end of each set of screens, the two sets of screens having facing sides adjacent each other and the obliquely extending screens descending from the respective upper end whereby the screens of the two sets enclose an angle.

This structure provides a relatively simple solution to the problem of substantially increasing the output of ballast cleaning machines. In a screening installation with such paired screens, the same amount of ballast will be cleaned while each set of screens is charged only with half the ballast amount and the delivery of the excavated ballast to the single inlet remains quite simple. The smaller amount of ballast in each set of screens can be sifted much more quickly than is possible when the entire amount is treated on a single set of screens because the tendency to.,jamming and clumping of the bulk material on the screens is considerably reduced. This enables the ballast excavating and conveying chain to be operated at a higher speed so that the entire operation is highly efficient. The screening installation of the present invention has the added advantage that, compared to a conventional screening installation of the same length and height, the angle of inclination of the screens of one or both sets of screens may be increased, for example by adjustably mounting the screens for selecting their angle of inclination, so that the bulk material will pass more quickly therethrough while retaining efficient screening. Furthermore, the screening installation has to discharge ends for the cleaned ballast, which enables the cleaned ballast to flow rapidly and without jamming for redistribution to the track.

The above and other objects, advantages and features of this invention will become more apparent from the following detailed description of certain now preferred embodiments thereof, taken in conjunction with the accompanying schematic drawing wherein FIG. 1 is a fragmentary side elevational view of a ballast cleaning machine incorporating one embodiment of the novel screening installation;

Figure 1:
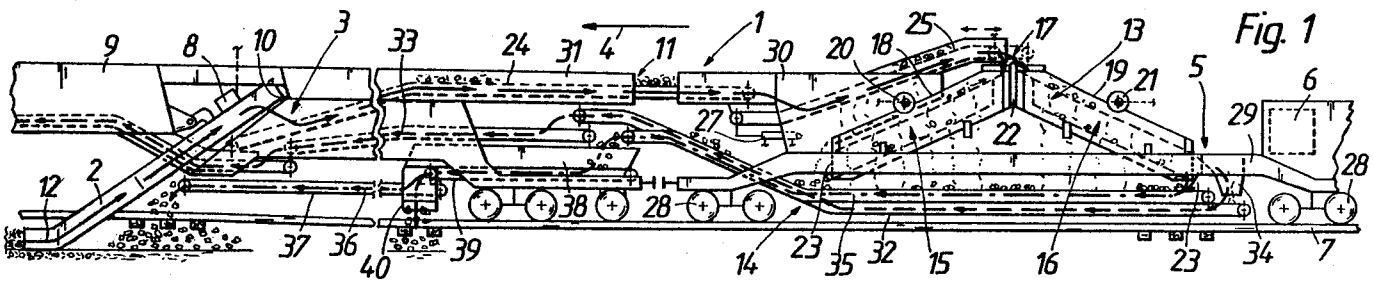
Figure 2:
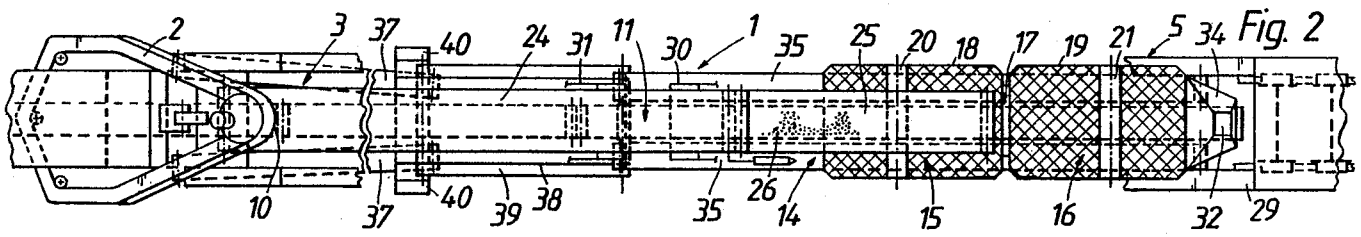
FIG. 2 is a top view of the machine of FIG. 1.
Figure 3:
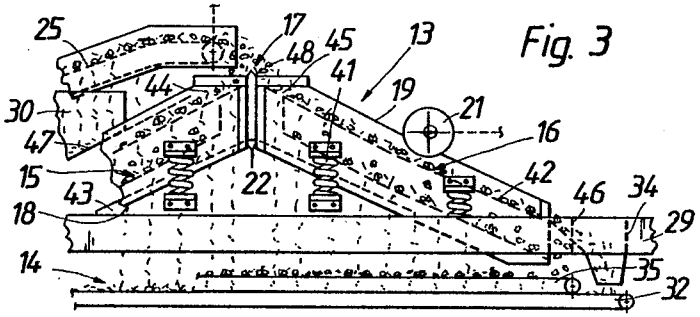
FIG. 3 is an enlarged fragmentary side elevational view of the screening installation of FIGS. 1 and 2.

Referring now to the drawing and first to FIGS. 1 to 3, the track working machine adapted to receive, clean and convey bulk material is illustrated as ballast cleaning machine 1 which cleans the received bulk material by separating waste from the ballast which has been fouled by the waste over a period of time. The machine moves along track 7 in an operating direction indicated by arrow 4 and comprises leading vehicle 3 supporting chain 2 for excavating the bulk material (comprised of ballast and waste fouling the ballast) and for conveying the excavated bulk material to discharge end 10, and trailing vehicle 5 comprising frame 29 supported on undercarriages 28 and supporting screening installation 13. The two vehicles are coupled together and are movable along the track by common drive 6. The mounting of the heavy screening installation on a separate vehicle removes this load from the vehicle which bridges the trackless working zone where the fouled ballast is excavated and, at the same time, enables the screening installation to be increased in length to enhance its efficiency correspondingly. The excavating and conveying chain 2 is an endless chain driven by drive 8 and vertically adjustably linked to frame 9 of vehicle 3 for excavating fouled ballast and conveying it along a path indicated by long arrows 12.

The screening installation comprises two sets 15, 16 of vibratory screens 42 extending obliquely with respect to track 7 in the direction of elongation of machine 1. Sets 15, 16 of screens 42 are arranged sequentially in this direction and have common inlet area 17 receiving the fouled ballast from chain 2 at a respective upper end of each set of screens. The two sets of screens have facing sides 22 adjacent each other and forming the common inlet area, obliquely descending screens 42 descending from the respective upper end whereby the superposed screens of the two sets enclose an obtuse angle.

Machine 1 further comprises conveyor band arrangement 14 extending in the direction of elongation of the machine at least partially below screening installation 13, and this arrangement comprises two conveyor bands 35 for receiving the cleaned ballast from outlets 23 at lower ends of the sets of screens and further conveyor band 32 for receiving the waste from the screening installation, the further conveyor band being arranged therebelow and centrally between the two conveyor bands 35. A portion of the waste discharged from trailing set 16 of screens 42 is moved to conveyor band 32 by chute arrangement 34 and the conveyor band removes the waste coming from the screening installation forwardly in the direction indicated by arrow 33 shown in broken lines. This very simple conveyor band arrangement assures the fastest possible and most efficient discharge of the cleaned ballast from the two sets of screens without any danger of jamming, and an equally efficient conveyance of the cleaned ballast for redistribution.

In the illustrated embodiment, a respective intermediate conveyor band 39 for the cleaned ballast is arranged to lead each conveyor band 35 and each intermediate conveyor band cooperates with storage container 38 for the cleaned ballast received from conveyor bands 35. A respective cleaned ballast distributing conveyor band 37 is arranged between intermediate conveyor bands 39 and excavating and conveying chain 2 to receive the cleaned ballast from the intermediate conveyor bands, and conveyor bands 37 are laterally pivotal. The front end of storage container 38 has four outlets, two of the storage container outlets (not shown) discharging the cleaned ballast to distributing conveyor bands 37 while two outlets 40 are chutes distributing cleaned ballast on the shoulders of the track. The intermediate storing of cleaned ballast enables the machine to operate continuously under varying ballast bed conditions. For example, if the excavated ballast is heavily fouled and, therefore, a reduced amount of cleaned ballast is received from the screening installation, the stored ballast will enable the distributing conveyor bands to receive a sufficient amount of ballast for providing the desired ballast bed. On the other hand, if the amount of cleaned ballast received from the screening installation exceeds the amount needed for the desired ballast bed, this excess amount will be stored.

In the illustrated embodiment, the machine comprises further conveyor band arrangement 11 between discharge end 10 of excavating and conveying chain 2 and common inlet area 17 of screening installation 13 for conveying the fouled ballast discharged from the chain to the common inlet area. This enables the screening installation to be spaced relatively far from the excavating and conveying chain discharge end so that the screening installation will not interfere with the free movement of the chain for proper positioning thereof.

Illustrated further conveyor band arrangement 11 consists of two conveyor bands 24, 25 arranged in succession in the direction of elongation of the machine. Trailing conveyor band 25 has a discharge end above common inlet area 17 and defines openings 26 to permit passage of at least a portion of the waste forming part of the excavated bulk material. Openings 26 are only partially shown in FIG. 2 and may be round or slot-shaped so that the material is pre-sifted before it reaches the screening installation. Conveyor band 25 is displaceable in horizontal guides extending in the direction of elongation of the machine and drive 27 is arranged to displace conveyor band 25 in selected positions for delivering selected portions of the excavated ballast to one of the sets of screens or to both sets of screens. Support walls 30 are mounted on vehicle frame 29 at respective sides of conveyor band 25 and carry the horizontal guides for this conveyor band. Conveyor band 24 is supported on walls 31 mounted on vehicle 3 at respective sides thereof.

This arrangement increases the output of the machine with a minimal additional structural modification since the pre-sifting of the bulk material enhances the cleaning capacity of the screening installation, due to the presence of a reduced amount of waste in the ballast to be cleaned in the screening installation. Therefore, the forward speed of the machine during ballast cleaning operations and the daily output of cleaned ballast will be further enhanced. The selective displacement of sifting conveyor band 25 makes it possible to move the discharge end of the conveyor band so that, depending on operating conditions, more, less or no material will be delivered to a selected one of the sets 15, 16 of screens.

As shown in the illustrated embodiments, the two sets of screens are arranged symmetrically with respect to a vertical plane extending transversely to the direction of elongation of the machine. This construction is simple and assures a uniform load on the supporting vehicle frame 29 when the two sets of screens operate at the same capacity.

In the embodiment best shown in FIG. 3, two separate screen casings 18, 19 having face end walls adjacent each other house the two sets of screens independently of each other, common inlet area 17 being arranged at the facing end walls of the casings. The box-like screen casings are of rectangular cross section and are resiliently supported on heavy springs 41 so that the casings may be freely oscillated. A respective vibrating drive 20, 21 is provided for each casing. Each set 15, 16 consists of two superposed screens 42, the upper screen having larger screen openings than the lower screen. The two screen casings 18, 19 are partially supported directly on vehicle frame 29 and partially on vertical supporting wall 43 whose lower end is welded to frame 29 and whose upper edge subtends the bottom of casings 18, 19 while forming a lateral gap permitting the free oscillation of the casings. This mounting assures that the waste falling through screens 42 will fall by gravity on central waste conveyor band 32. The facing end walls of the screen casings have platforms 44, 45 projecting horizontally in opposite directions and constituting common inlet area 17 for the two sets of screens. Funnel-shaped chutes 46 are mounted at the lower discharge ends 23 of set 16 to deliver cleaned ballast to conveyor bands 35 mounted therebelow. The waste separated by upper screen 42 is delivered by funnel-shaped chute 34 to waste removal conveyor band 32. The two screen casings have essentially the same structure.

This simple structure will enable the vibrating drives to impart a high frequency to the screen vibrations at a relatively low energy consumption whereby a far-reaching separation of the waste is assured economically. Furthermore, the independent mounting of the two sets of screens in separate housings makes it possible to shut off the operation of one set of screens entirely when only a relatively small amount of bulk material is to be cleaned along certain track sections, thus further saving energy costs. In this case, conveyor band 25 is displaced so as to deliver all the excavated bulk material into one of the sets of screens and the vibrating drive of the other set of screens remains inoperative. This provides the machine with an additional economically advantageous feature. The economy of the machine is further enhanced when the screen casings have essentially the same structure. Also, particularly if the size of the screening installation is large, two separate and independent screen casings make assembly of the installation easier.

Figure 4:
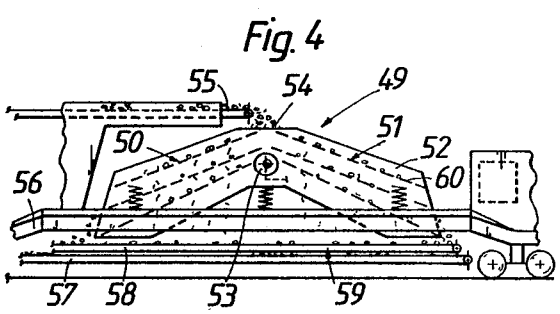
FIG. 4 is a like view of another embodiment of the screening installation.

Screening installation 49 illustrated in FIG. 4 comprises common casing 52 mounted on vehicle frame 56 and housing two sets 50, 51 of three superposed screens 60 of different mesh sizes, and vibrating drive 53 for vibrating the casing. Common inlet area 54 is arranged in casing 52 substantially centrally in the direction of elongation of the machine. This construction is of particular advantage for smaller installations since it requires only one casing and one vibrating drive. The excavated bulk material is delivered to common inlet area 54 by intermediate conveyor band arrangement 55 which is supported by vertical support walls in a manner generally similar to the equivalent structure in the embodiment of FIGS. 1 to 3. Also similarly to the first-described embodiment, conveyor band arrangement 59 comprising waste removal conveyor band 57 and cleaned ballast redistributing conveyor bands 58 is mounted below the screening arrangement.

The operation of ballast cleaning machine 1 will partly be obvious from the above description of its structure and will be further explained hereinabove:

While machine 1 continuously advances along track 7 in the direction of arrow 4, fouled ballast is excavated and conveyed in the direction of long arrows 12 to discharge end 10 of excavating and conveying chain 2 whence intermediate conveyor arrangement 24, 25 (or 55) delivers it to common inlet area 17 (or 54) of the screening installation. If conveyor band 25 with openings 26 is used in this intermediate conveyor band arrangement, the fouled ballast will be pre-sifted before it reaches the screening installation. In the screening installation, the waste is separated and falls through chute arrangement 34 on waste removal conveyor band 32 (or 57). The cleaned ballast is delivered from the two discharge outlets 23 to conveyor bands 35 (or 58) whence conveyor band 39 conveys the cleaned ballast to storage container 38 whence it is conveyed further to pivotal distributing conveyor bands 37 which discharge the cleaned ballast through the track to the exposed subgrade. The waste is removed by conveyor band 32 (or 57) to further conveyors in the direction of arrow 4 to be taken to freight cars or be discharged at the track shoulders.

What is claimed is:

1. A track working machine adapted to receive, clean and convey bulk material, which comprises (a) a chain mounted for excavating the bulk material and for conveying the excavated bulk material to a discharge end, (b) a screening installation arranged to receive the excavated bulk material from the discharge end of the excavating and conveying chain, and to clean the received bulk material by separating waste from the bulk material, the screening installation comprising (1) a supporting frame and (2) two sets of a plurality of superposed vibratory screens extending obliquely with respect to the track in the direction of elongation of the machine, the sets of screens being arranged sequentially in, and symmetrically with respect to a vertical plane extending transversely to, said direction and having a common inlet area receiving the bulk material from the chain at a respective upper end of each set of screens, the two sets of screens having facing sides adjacent each other and the obliquely extending screens descending from the respective upper end whereby the screen; of the two sets enclose an angle, the bulk material flowing on the screens in said direction, and (c) a conveyor band arrangement extending in said direction at least partially below the screening installation, the conveyor band arrangement comprising (1) at least one conveyor band for receiving cleaned bulk material from the screening installation and (2) at least one further conveyor band for receiving the waste from the screen installation.

2. The track working machine of claim 1, comprising a further conveyor band arrangement between the discharge end of the excavating and conveying chain and the common inlet area of the screening installation for conveying the bulk material discharged from the chain to the common inlet area.

3. The track working machine of claim 1, further comprising two separate screen casings having facing end walls adjacent each other and housing the two sets of screens independently of each other and a respective vibrating drive for vibrating a respective one of the casings, the common inlet area being arranged at the facing end walls of the casings.

4. The track working machine of claim 3, wherein the two casings have essentially the same structure.

5. The track working machine of claim 1, further comprising a common casing housing the two sets of screens and a vibrating drive for vibrating the casing, the common inlet area being arranged in the casing substantially centrally in said direction.

6. The track working machine of claim 1, comprising a leading vehicle supporting the bulk material excavating and conveying chain, and a trailing vehicle supporting the screening installation.

7. The track working machine of claim 1, wherein the sets of screens have respective outlets at lower ends thereof, the conveyor band arrangement comprises two of said conveyor bands for receiving the cleaned bulk material from the outlets of the screening installation, and the conveyor band for receiving the waste from the screening installation is arranged therebelow and centrally between the two conveyor bands.

8. The track working machine of claim 7, further comprising a respective intermediate conveyor band for the cleaned bulk material arranged to lead each one of the two conveyor bands, each one of the intermediate conveyor bands cooperating with a storage container for the cleaned bulk material received from the two conveyor bands, and a respective cleaned bulk material distributing conveyor band arranged between the intermediate conveyor bands and the bulk material excavating and conveying chain, the distributing conveyor bands being arranged to receive the cleaned bulk material from the intermediate conveyor bands and being laterally pivotal.

9. A track working machine adapted to receive, clean and convey bulk material, which comprises (a) a chain mounted for excavating the bulk material and for conveying the excavated bulk material to a discharge end, (b) a screening installation arranged to receive the excavated bulk material from the discharge end of the excavating and conveying chain, and to clean the received bulk material by separating waste from the bulk material, the screening installation comprising (1) a supporting frame and (2) two sets of vibratory screens extending obliquely with respect to the track in the direction of elongation of the machine, the sets of screens being arranged sequentially in, and symmetrically with respect to a vertical plane extending transversely to, said direction and having a common inlet area receiving the bulk material from the chain at a respective upper end of each set of screens, the two sets of screens having facing sides adjacent each other and the obliquely extending screens descending from the respective upper end whereby the screens of the two sets enclose an angle, (c) a conveyor band arrangement extending in said direction at least partially below the screening installation, the conveyor band arrangement comprising (1) at least one conveyor band for receiving cleaned bulk material from the screening installation and (2) at least one further conveyor band for receiving the waste from the screen installation, and (d) a further conveyor band arrangement between the discharge end of the excavating and conveying chain and the common inlet area of the screening installation for conveying the bulk material discharged from the chain to the common inlet area, the further conveyor band arrangement consisting of (1) two conveyor bands arranged in succession in said direction, a trailing one of the conveyor bands of the further conveyor band arrangement having a discharge end above the common inlet area and defining openings to permit passage of at least a portion of the waste forming part of the bulk material.

10. The track working machine of claim 9, wherein the one conveyor band of the further conveyor band arrangement is displaceable in said direction, and further comprising a drive for displacing the further conveyor band in selected positions for delivering selected portions of the bulk material to one of the sets of screens or to both sets of screens.

* * * * *